US005151047A

United States Patent [19]

Phillips

[11] Patent Number: 5,151,047

[45] Date of Patent: Sep. 29, 1992

[54] CONNECTOR FOR CONNECTON TO A CELLUAR TELEPHONE

[75] Inventor: Michael J. Phillips, Camp Hill, Pa.

[73] Assignee: AMP Incorporated, Harrisburg, Pa.

[21] Appl. No.: 742,772

[22] Filed: Aug. 8, 1991

[51] Int. Cl.[5] ..... H01R 4/50

[52] U.S. Cl. ..... 439/333; 439/916; 439/581

[58] Field of Search ..... 439/332, 333, 334, 546, 439/549, 578, 581, 672, 916, 604, 606, 456, 582

[56] References Cited

U.S. PATENT DOCUMENTS

| | | | |
|---|---|---|---|
| 1,134,673 | 4/1915 | Douglas | 439/546 X |
| 1,726,656 | 9/1929 | Davies | 439/549 |
| 4,221,452 | 9/1980 | Remington | 439/333 |
| 4,424,553 | 1/1983 | Marsocci et al. | 439/333 X |
| 4,445,741 | 5/1984 | Annoot | 439/456 X |
| 4,611,213 | 9/1986 | Johnson et al. | 343/702 |
| 4,867,698 | 9/1989 | Griffiths | 439/317 |

FOREIGN PATENT DOCUMENTS

| | | |
|---|---|---|
| 2937731 | 3/1981 | Fed. Rep. of Germany . |
| 1349413 | 4/1974 | United Kingdom . |

*Primary Examiner*—Larry I. Schwartz
*Assistant Examiner*—Khiem Nguyen

[57] ABSTRACT

An electrical connector 1 for connection to an antenna mount comprises, a dielectric body 2, a conductive shell 3, and bayonet coupling prongs 4, a conductive center contact 5 having a stem 26 projecting outwardly from the shell 3 and being reciprocatable to retract a wire connection portion 28 of the stem 26 into the dielectric body 2, after connection to a wire 23 of a coaxial cable 19, a coil spring 6 and a spring retainer 7 adapted to impinge an antenna mount of a cellular telephone, the coil spring 6 being compressible between the retainer 7 and an outer flange 11 of the shell 3 when the bayonet prongs 4 are connected to the antenna mount.

6 Claims, 4 Drawing Sheets

CONNECTOR FOR CONNECTON TO A CELLUAR TELEPHONE

FIELD OF THE INVENTION

The specification discloses an electrical connector for attaching a coaxial cable or for attaching a portable antenna to a cellular telephone.

BACKGROUND OF THE INVENTION

U.S. Pat. No. 4,867,698 discloses a radio frequency transceiver adapted with an antenna mount for attaching a replaceable antenna that is portable with the transceiver. An electrical connector portion of the antenna is adapted for disconnection from the antenna mount advantageously to replace the antenna when it becomes damaged.

Similarly, a cellular telephone is provided with an antenna mount for connecting a portable antenna. The antenna mount for a cellular telephone is utilized for another purpose, to connect the telephone to a cable extending from a remote antenna, for example, an antenna that is mounted on the exterior of an automobile instead of being portable with the cellular telephone. By removing the portable antenna, the antenna mount of the cellular telephone is freed for connection to a coaxial cable projecting from the remote antenna. A need exists to provide an electrical connector for a coaxial cable adapted for connection to an antenna mount of a cellular telephone.

DESCRIPTION OF THE INVENTION

An advantage of the invention resides in an electrical connector for a coaxial cable adapted for connection to an antenna mount of a cellular telephone.

A further advantage of the invention resides in an electrical connector for connecting a coaxial cable of a remote antenna to a cellular telephone.

A further objective of the invention is to provide an electrical connector adapted for connection to an antenna mount of a cellular telephone.

A further objective of the invention is to provide an electrical connector for connection to a housing of a cellular telephone, said connector having an external, spring biased retainer impinging the housing, and a shell that is inserted in a passage of the housing and is rotated in the passage to impinge bayonet coupling prongs against an interior surface of the housing.

These and other objectives and advantages of the invention will become apparent from a description of an embodiment of the invention, taken in conjunction with accompanying drawings.

DETAILED DESCRIPTION

Figure 5:
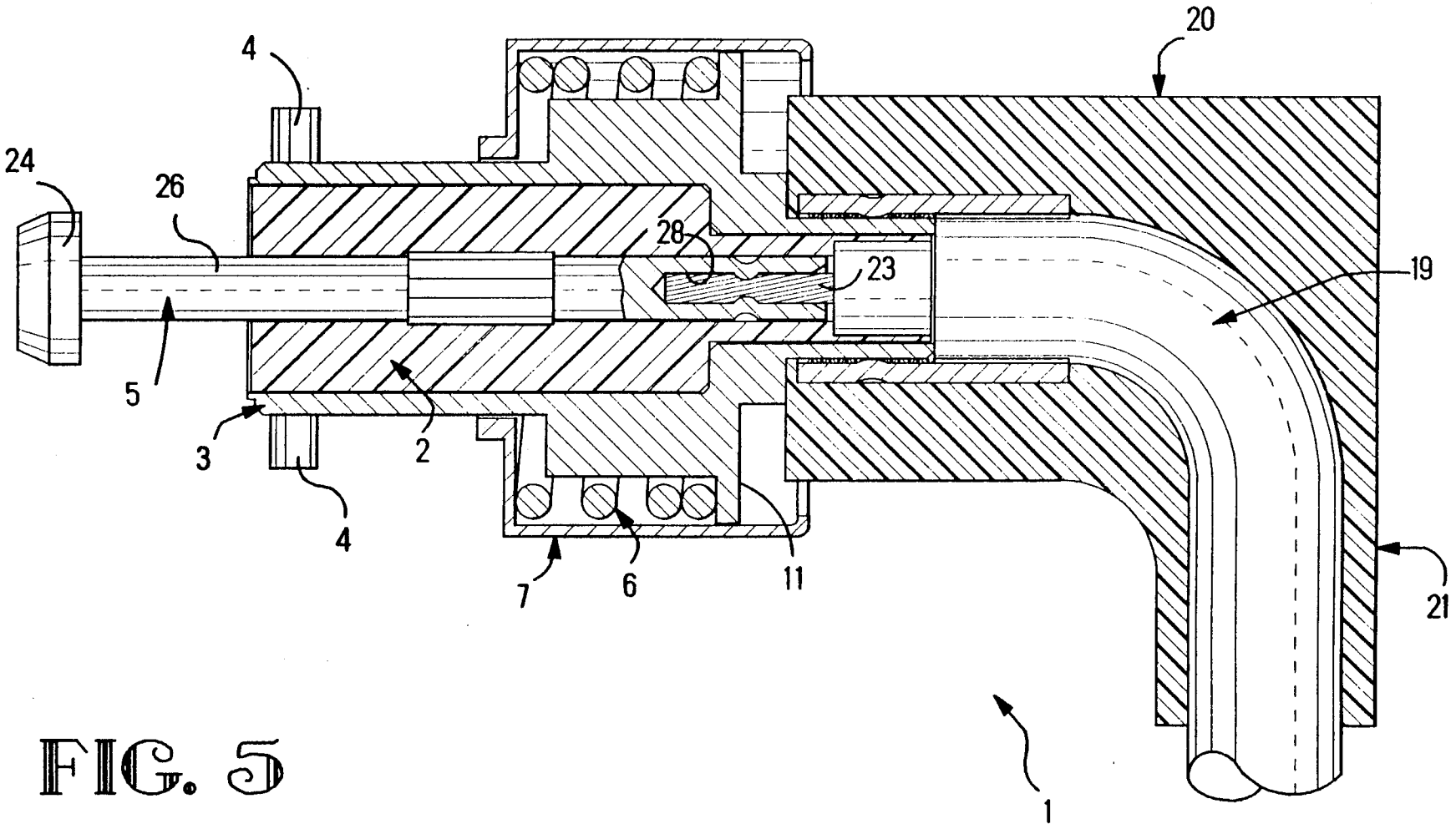
FIG. 5 is an enlarged elevation in section of the electrical connector of FIG. 1 and a portion of the cable of FIG. 1.

With reference to FIG. 5, there is disclosed an electrical connector 1 comprising, a dielectric body 2, a conductive shell 3 concentrically encircling said dielectric body 2 and provided with projecting bayonet coupling prongs 4, a conductive center contact 5 concentrically surrounded by said dielectric body 2 and projecting outwardly from said dielectric body 2 and said shell 3, a coil spring 6 encircling said shell 3, and a spring retainer 7 in the form of a ring sleeve surrounding the coil spring 6 and being rotatable relative to the shell 3.

Figure 6:
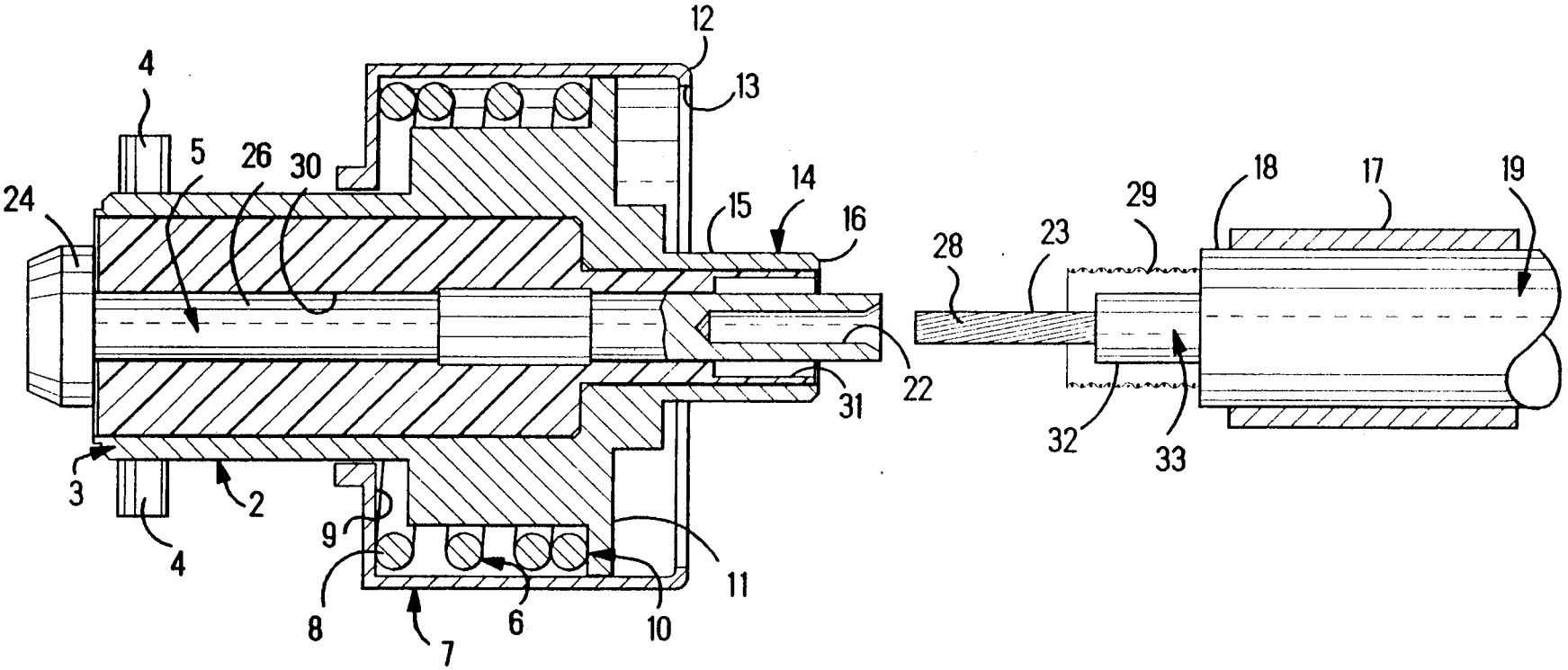
FIG. 6 is a view similar to FIG. 5 with parts illustrated apart from one another.

With reference to FIGS. 5 and 6, a front end 8 of the coil spring 6 impinges against a rear facing shoulder 9 of the retainer 7. A rear end 10 of the spring 6 impinges against an external diametrically projecting flange 11 of the shell 3 that is encircled by the retainer 7. A rear end 12 of the retainer 7 has an inwardly projecting lip 13 that overlaps the flange 11 to limit rearward movement of the shell 3 with respect to the retainer 7.

The electrical connector 1 further includes anchoring means 14 comprising, a reduced diameter sleeve portion 15 at a rear end 16 of the shell 3 and a cylindrical, crimp ferrule 17 encircling the sleeve portion 15 of the shell 3, FIG. 5, and an end portion 18 of an electrical, coaxial cable 19 of a remote antenna, not shown, for example, an antenna adapted for mounting on an exterior of an automobile, not shown. Further included is a strain relief 20 in the form of a hollow tube 21 of polymeric material that encircles the cable 19 and is overmolded in place after the crimp ferrule 17 is secured to the cable portion 18 and the sleeve portion 15 of the shell 3 to encircle the cable 19 and the ferrule 17. The strain relief 20 alleviates a concentration of stress on the cable 19 caused by bending the cable 19 severely at the ferrule 17 of the anchoring means 14. The strain relief 20 extends in a curved path to hold the cable 19 in a corresponding curved path.

The center contact 5 is unitary in construction, with a wire connection portion 22 for connection to a signal carrying conductor or wire 23 of the coaxial cable 19. Further the center contact 5 includes a smooth, rounded knob 24 at a front end for receipt in an electrical receptacle 25, FIGS. 1 and 2, of a cellular telephone. An elongated ribbed stem 26 of the contact 5 has longitudinal ribs 27 with a longitudinal, sliding interference fit with the dielectric body 2, and has the wire connecting portion 22 into which a protruding front portion 28 of the signal carrying wire 23 is inserted and received.

The stem 26 is inserted along a concentric passage 30 of the dielectric body 2. The ribs 27 of the stem 26 interfere with the dielectric body 2 to prevent relative rotation, and slidably fit longitudinally with the passage 30 of constant diameter. With reference to FIG. 5, the wire connection portion 22 first projects outwardly from a rear of the dielectric body 2, and is attached to the signal carrying wire 23 by crimping. A conductive shield 29 of the cable 19 is enveloped concentrically over the sleeve portion 15, FIG. 5. The crimp ferrule 17 is then slid along the cable 19 to concentrically surround both the cable 19 and the shield 29, and is crimped to both, FIG. 5. With reference to FIGS. 5 and 6, the stem 26 is slidably moved longitudinally in the passage 30 of the dielectric body 2 to retract said wire connecting portion 28 into a rear facing socket 31 of the dielectric body 2, together with the protruding front portion 28 of the wire 23 and a protruding front portion 32 of a dielectric sheath 33 of the cable 19, the end of which sheath 33 faces the wire connecting portion 22, and encircles the wire 23 and is of larger diameter than the wire 23. The diameter of the socket 31 is larger than the diameter of the passage 30 for the stem 26. The dielectric sheath 33 faces an end of the socket 31 and prevents further forward movement of the center contact 5. The ribs 27 interfere with the dielectric body 2 tending to prevent relative sliding movement. A front portion of the stem 26 will then project outwardly of a front of the dielectric body 2, FIG. 5, and a front of the shell 3 for projecting the knob 24 outwardly beyond the shell 3 for connection to an antenna mount 34, FIG. 1, of the cellular telephone.

Figure 1:
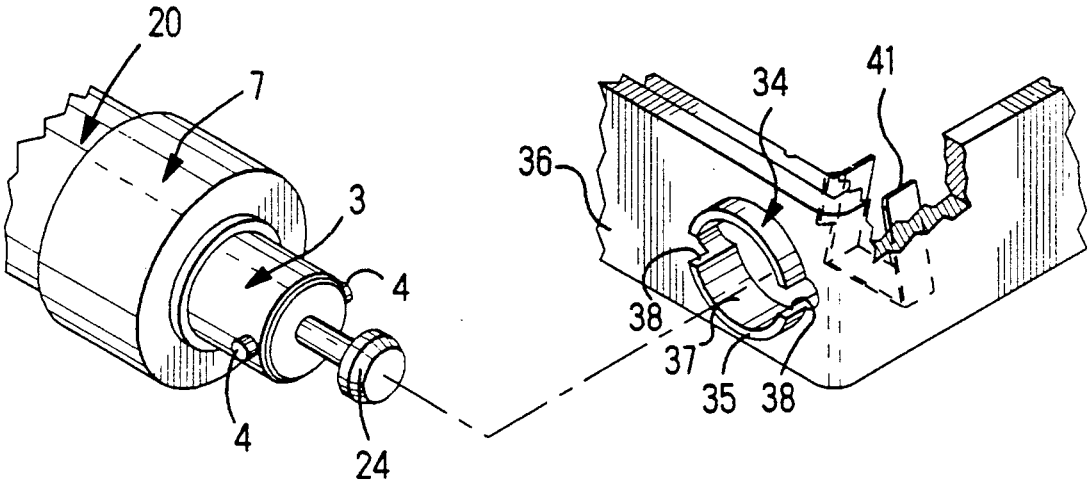
FIG. 1 is a fragmentary perspective view of an electrical connector for connection to a coaxial cable, and an antenna mount of a cellular telephone.
Figure 2:
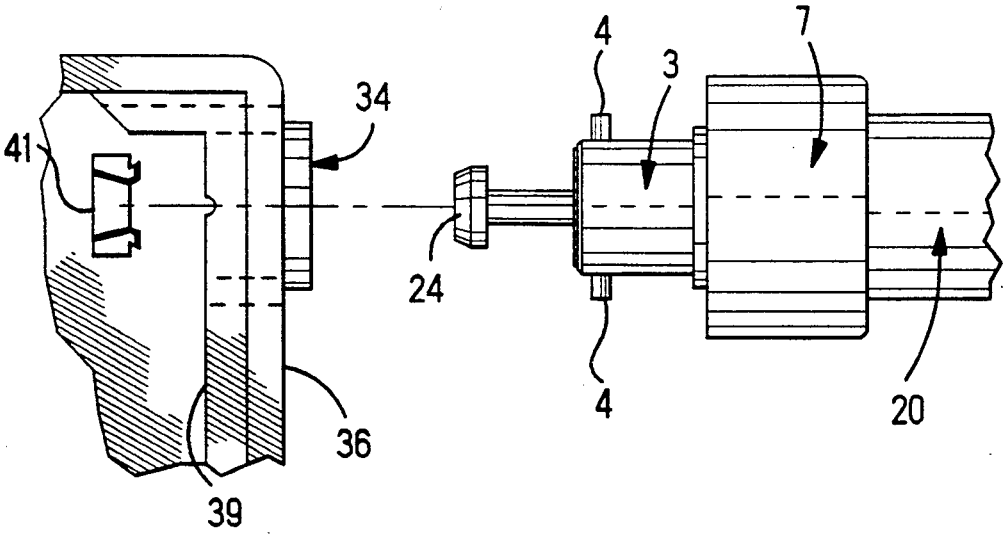
FIG. 2 is a fragmentary elevation view of the structure shown in FIG. 1.

With reference to FIG. 1, the antenna mount 34 includes a raised boss 35 on a housing 36 of the cellular telephone, and a cylindrical passage 37 with radially extending channels 38 diametrically opposed across the passage 37 extending through the boss 35 to an interior surface 39, FIG. 2, of the housing 36. The connector 1 is mounted to the antenna mount 34 according to the following procedure. The connector 1 is grasped. The knob 24 of the stem 26 is inserted through the passage 37, causing the spring 6 to compress as the spring retainer 7 is impinged against the antenna mount 34 on the exterior of the housing 36 while the shell 3 of the connector 1 moves along the passage 37 against the bias of the spring 6. A diameter of the passage 37 is larger than that of the exterior of the shell 3 and is smaller than the outer diameter of the retainer 7. The coupling prongs 4 pass through the diametrically opposed channels 38 of the passage 37.

Figure 3:
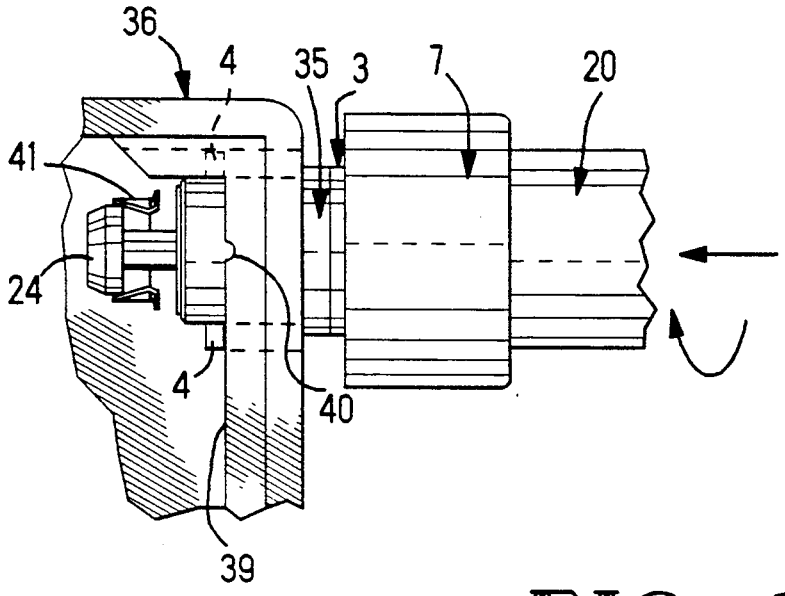
FIG. 3 is a view similar to FIG. 2 illustrating partial assembly of the electrical connector of FIG. 1 with the antenna mount of FIG. 1.
Figure 4:
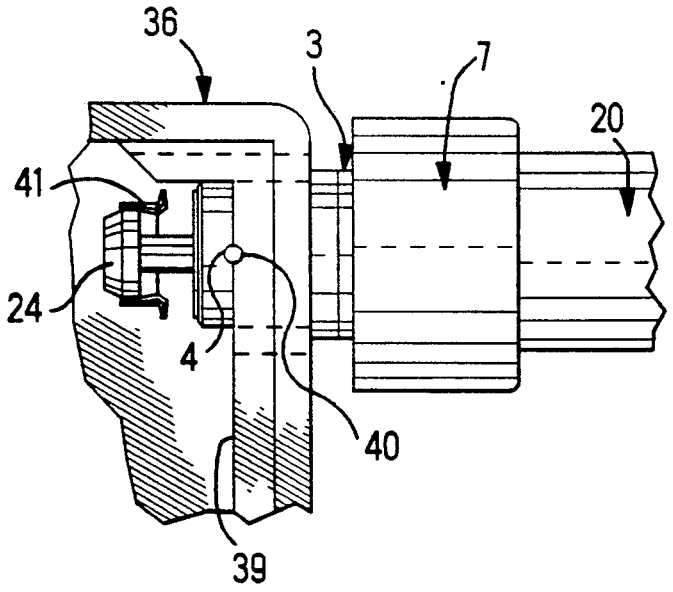
FIG. 4 is a view similar to FIG. 3 illustrating complete assembly of the electrical connector with the antenna mount.

With reference to FIG. 3, when the coupling prongs 4 emerge from the passage 37, they will extend into the housing 36 beyond the boss 35. Then, the shell 3 is rotated or revolved a quarter turn, FIG. 4, with respect to the passage 37, revolving the prongs 4 through a quarter turn. When the connector 1 is released from being grasped, the spring 6 will expand and cause the shell 3 to move in a direction outwardly away from the housing 36, and the coupling prongs 4 will seat in recesses 40 in the interior surface 39 of the housing 36 that is conveniently recessed to deter rotation of the shell 3, while the coupling prongs 4 are seated. The knob 24 will be clasped by an electrical receptacle 41 inside the housing 39, whereby the signal wire 23 of the cable 19 is connected electrically inside of the housing 39. To disconnect the connector 1 from the antenna mount 34, the shell 3 must be grasped and moved in a direction into the housing 36 against the bias of the spring 6, followed by rotation of the shell 3 and the coupling prongs 4 to align the prongs 4 with the channels 38 of the passage 37, followed by removal of the shell 3 and the prongs 4 along the passage 37.

I claim:

1. An electrical connector for connection to an antenna mount of a cellular telephone, comprising:

a dielectric body, a conductive shell concentrically encircling said dielectric body and provided with projecting bayonet coupling prongs for connection to an antenna mount of a cellular telephone, a conductive center contact having a stem concentrically surrounded by said dielectric body and projecting outwardly from said dielectric body and said shell, said stem having a front end for receipt in an electrical receptacle of a cellular telephone, said stem having a wire connection portion for connection to a signal carrying conductor of a coaxial cable, said stem being moveable to project said stem outwardly from said dielectric body, and to retract said wire connection portion into said dielectric body after connection of said wire connection portion to a signal carrying conductor of a coaxial cable, anchoring means for anchoring said shell to said coaxial cable after retraction of said wire connecting portion into said shell, a coil spring encircling said shell, and a ring retainer encircling said coil spring and being adapted to impinge an antenna mount of a cellular telephone, said coil spring being compressible between said retainer and an outer flange of the shell when said bayonet prongs are connected to said antenna mount.

2. An electrical connector as recited in claim 1, wherein, said anchoring means comprises a sleeve portion of said shell, and a ferrule encircling said sleeve portion and a portion of said cable.

3. An electrical connector as recited in claim 1, and further comprising:

a hollow strain relief encircling the anchoring means and holding said cable in a curved path.

4. An electrical connector as recited in claim 1, and further comprising: said shell being adapted for receipt in a passage of a housing of said cellular telephone, said retainer being biased by said spring to impinge the housing, and said shell being rotatable in the passage to impinge said bayonet coupling prongs against an interior surface of the housing.

5. An electrical connector as recited in claim 4 wherein, said passage includes channels communicating with said interior surface of said housing adapted for passage of said prongs into and out of said housing.

6. An electrical connector for connection to an antenna mount of a cellular telephone, comprising:

a dielectric body, a conductive shell concentrically encircling said dielectric body and provided with projecting bayonet coupling prongs for connection to an antenna mount of a cellular telephone.

a conductive center contact having a stem concentrically surrounded by said dielectric body and projecting outwardly from said dielectric body and said shell, said stem having a front end for receipt in an electrical receptacle of a cellular telephone, said stem having a wire connection portion for connection to a signal carrying conductor of a coaxial cable, said stem being moveable to project said stem outwardly from said dielectric body, and to retract said wire connection portion into said dielectric body after connection of said wire connection portion to a signal carrying conductor of a coaxial cable, anchoring means for anchoring said shell to said coaxial cable after retraction of said wire connecting portion into said shell, a coil spring encircling said shell, and a ring retainer encircling said coil spring and being adapted to impinge an antenna mount of a cellular telephone, said coil spring being compressible between said retainer and an outer flange of the shell when said bayonet prongs are connected to said antenna mount, a housing of said cellular telephone having a passage for receiving said shell, a diameter of said passage being larger than that of the exterior of said shell and smaller than the outer diameter of said retainer, a flange of said shell, said retainer impinging said shell and compressing said coil spring against said flange while said shell is received by said passage, and channels intersecting said passage and receiving said prongs, said channels extending through a back surface of the housing against which said prongs engage when said shell has been rotated relative to said passage.

* * * * *